US005333586A

United States Patent [19]

Fukui

[11] Patent Number: 5,333,586

[45] Date of Patent: Aug. 2, 1994

[54] CONTROL APPARATUS FOR INTERNAL COMBUSTION ENGINE

[75] Inventor: Wataru Fukui, Himeji, Japan

[73] Assignee: Mitsubishi Denki Kabushiki Kaisha, Tokyo, Japan

[21] Appl. No.: 76,136

[22] Filed: Jun. 14, 1993

[30] Foreign Application Priority Data

Jun. 25, 1992 [JP] Japan ..... 4-167556

[51] Int. Cl.[5] ..... F02P 7/067

[52] U.S. Cl. ..... 123/414

[58] Field of Search ..... 123/414, 476, 612, 613, 123/617, 643

[56] References Cited

U.S. PATENT DOCUMENTS

| | | | |
|---|---|---|---|
| 4,494,509 | 1/1985 | Long | 123/414 X |
| 4,656,993 | 4/1987 | Yuzawa et al. | 123/414 X |
| 4,766,865 | 8/1988 | Hartel | 123/414 |
| 4,873,958 | 10/1989 | Abe | 123/414 X |
| 4,924,830 | 5/1990 | Abe | 123/414 |
| 4,979,487 | 12/1990 | Fukui | 123/643 |
| 5,074,275 | 12/1991 | Fukui | 123/414 X |
| 5,099,810 | 3/1992 | Borst | 123/414 |
| 5,245,968 | 9/1993 | Kolias et al. | 123/414 |

*Primary Examiner*—Willis R. Wolfe

*Attorney, Agent, or Firm*—Sughrue, Mion, Zinn, Macpeak and Seas

[57] ABSTRACT

An apparatus for controlling operation of a four-cycle internal combustion engine including an odd number of cylinders comprises a reference position signal generator 1A driven by the crank shaft whose output includes a number of constant-interval pulses generated periodically at a predetermined constant time interval during a single rotation of the crank shaft, such number being equal to N times the number of cylinders, a cylinder identification signal generator 2A driven by the cam shaft interlocked to and at half the speed of the crank shaft, whose output includes a number of different-interval pulses corresponding to the number of cylinders, a synthesized reference position signal generator 33 for generating a signal T2 by dividing the frequency of the reference position signal by ½N, a cylinder discriminator 34, 31A for generating a cylinder discrimination signal F, and a timing control unit 32. The synthesized reference position signal is generated with high accuracy because the reference position signal is generated by a detector mounted directly on the crank shaft and thus protected against errors due to driving power transmission.

6 Claims, 7 Drawing Sheets

CONTROL APPARATUS FOR INTERNAL COMBUSTION ENGINE

BACKGROUND OF THE INVENTION

1. Field of the Invention

The present invention relates generally to an apparatus for controlling operation of a four-cycle internal combustion engine (hereinafter also referred to simply as the engine) having an odd number of cylinders by controlling fuel injections, ignition timings and the like for the individual cylinders of the engine on the basis of a reference position signal and a cylinder identification signal. More particularly, the invention is concerned with an engine control apparatus in which the reference positions for the individual cylinders can be determined with an enhanced accuracy and which can ensure a high reliability for the engine operation control.

2. Description of the Related Art

In general, in the four-cycle engine for an automobile or motor vehicle in which four strokes of suction, compression, explosive combustion and exhaust of air-fuel gas mixture are effected, it is required to control optimally the fuel injection and the ignition timing in conformance with the operation state of the engine or motor vehicle. To this end, there is provided a signal generating means inclusive of a sensor in association with a rotatable shaft of the engine for making available a reference position signal indicating reference positions for the individual engine cylinders and a cylinder identification signal for identifying the individual cylinders, respectively. Further, a microcomputer is used for detecting a reference crank angle position for each cylinder on the basis of the signals mentioned above and effectuating timer-based control operation on the basis of the reference positions for the cylinders by determining through calculation the control timing such as the ignition timing, fuel injection timing and/or the like.

FIG. 5 is a block diagram showing an engine control apparatus known heretofore for a four-cycle engine which includes, for example, five cylinders.

Referring to the figure, this known engine control apparatus includes a reference position signal generating means 1 for generating a reference position signal T corresponding to a reference crank angle position on a cylinder basis in synchronism with rotation of an engine (not shown) and a cylinder identification (ID) signal generating means 2 for generating a cylinder identification signal C for identifying a particular cylinder in synchronism with rotation of the engine. Each of the reference position signal generating means 1 and the cylinder identification signal generating means 2 is constituted by a rotatable slit disk mounted, for example, on a crank shaft or a cam shaft interlocked thereto and photo-detectors disposed in opposition to the rotatable slit disk, as described hereinafter.

The reference position signal T and the cylinder identification signal C are inputted to a control means 3 which can be implemented by using a microcomputer and which is adapted to detect the reference positions of the individual cylinders on the basis of the reference position signal T and the cylinder identification signal C and calculate the ignition timing or the like control parameters in dependence on the operation state of the engine to thereby output a control signal (e.g., ignition coil turn-on/off control signal) for controlling, for example, the ignition timing.

As can be seen from FIG. 5, the control means 3 includes a cylinder discrimination unit 31 for generating a cylinder discrimination signal F on the basis of the reference position signal T and the cylinder identification signal C and a timing control unit 32 for generating a control signal (e.g., ignition timing control signal) for each cylinder on the basis of the reference position signal T, the cylinder discrimination signal F and the engine operation state.

FIG. 6 is a perspective view showing typical structures of the reference position signal generating means 1 and the cylinder identification signal generating means 2. Referring to the figure, a slit disk 11 is mounted on a cam shaft 10 which is rotated in synchronism with the rotation of the engine. The cam shaft 10 is adapted to rotate once during a period in which a crank shaft (not, shown) rotates twice. A plurality of slits 12 and 13 are formed coaxially in the signal disk 11 in the direction in which the disk 11 is rotated, wherein the radially outer slits 12 (five arcuate slits corresponding to five cylinders, respectively) are so formed as to generate the reference position signal T for the individual cylinders, while the radially inner slit 13 is adapted to generate the cylinder identification signal C for identifying the particular cylinder.

A pair of light emitter elements 15 and 17 are disposed in opposition to a pair of light receiving elements 16 and 18, respectively, wherein a peripheral portion of the disk 11 having the slits 12 and 13 formed therein is interposed between the light emitter elements 15; 17 and the light receiving elements 16; 18. Thus, the light emitting element 15 and the light receiving element 16 cooperate to constitute a photo-detector disposed in opposition to the trace of the slits 12 for generation of the reference position signal T, while the light emitting element 17 and the light receiving element 18 constitute a photo-detector disposed in opposition to the path of the slit 13 for generation of the cylinder identification signal C.

FIG. 7 is a timing chart which illustrates the reference position signal T and the cylinder identification signal C. As can be seen in this figure, the reference position signal T includes pulses each having a leading edge rising up at a crank angle of B65° (indicating a crank angle 65° before the top dead center or TDC) of each cylinder and a trailing edge falling at a crank angle of B5°, wherein the position corresponding to the crank angle of B65° serves as the reference position for a maximum lag with the position corresponding to the crank angle of B5° being termed the second reference position. In terms of the crank angle, the total period of the reference position signal T for the five cylinders amounts to 720°, wherein one pulse period for each of the cylinders corresponds to 144°. Further, the pulse width or duration extending from the reference position B65° to tile second reference position B5° corresponds to 60° in terms of the crank angle, and a pulse quiescent duration intervening the second reference position B5° for a given one cylinder and the reference position B65° for the cylinder succeeding to that given one cylinder is 84° in terms of the crank angle.

On the other hand, the cylinder identification signal C contains a pulse of a different waveform for a particular cylinder (cylinder #1 in the case of the illustrated example) which differs in phase from the pulses contained in the reference signal position signal T so that the signal C has different signal levels at the reference position B65° and the initial reference position B5° for the cylinders. By way of example, by imparting such waveform to the pulse of the cylinder identification signal C that it assumes a signal level "1s" at both the crank angle positions B65° and B5°, respectively, it is possible to identify discriminatively the particular cylinder from the others. Generation of the pulses of the waveforms mentioned above can be realized by appropriately sizing the slits 12 and 13.

Next, description will turn to operation of the known engine control apparatus shown in FIG. 6 by reference to FIGS. 7 and 8.

When the engine rotates, the reference position signal generating means 1 constituted by the combination of the photoelements 15 and 16 and the slits 12 as well as the cylinder identification signal generating means 2 constituted by the combination of the photo-elements 17 and 18 and the slit 13 generate the reference position signal T and the cylinder identification signal C which have waveforms such as illustrated in FIG. 7, respectively. These signals T and C are supplied to the cylinder discrimination unit 31 and the timing control unit 32 incorporated in the control means 3.

On the basis of the reference position signal T and the cylinder identification signal C, the cylinder discrimination unit 31 discriminates or identifies discriminatively the individual cylinders, while the timing control unit 32 detects the reference positions for the individual cylinders to thereby determine through calculation the control quantity for controlling the ignition timing in dependence on the engine operation state, as a result of which the control signals for controlling the ignition timings for the individual cylinders are outputted from the control means 33. In that case, when the ignition timing is to advance, the timing control (or timer control) is performed with reference to the first reference position B65°, while when the ignition timing is to lag, the timing control is then performed with reference to the second reference position B5°.

At this junction, it is noted that the reference position generating means 1 is mounted on the cam shaft 10 together with the cylinder identification signal generating means 2, as shown in FIG. 6, wherein the cam shaft 10 is mechanically interlocked to the crank shaft. Consequently, the signals indicating the reference positions B65° and B5° on the cam shaft 10 unavoidably contain error which is ascribable to error in transmission of a driving power from the crank shaft to the cam shaft. For this reason, it is practically impossible or at least very difficult for the timing control unit 32 to control the engine operation on the basis of the reference position signal which lacks a sufficiently high accuracy.

Further, it should be mentioned that detection of the reference position signal T with a high accuracy is required not only for the ignition timing control but also for detection of fluctuation in the engine rotation speed (rpm) on the basis of ratios of the periods between the reference positions as well as detection of occurrence of misfiring in the engine on the basis of change in the engine rotation speed.

As will be appreciated from the above description, the engine control apparatus known heretofore suffers from a problem that because the reference position generating means 1 is mounted on the cam shaft 10 in case the engine includes an odd number of cylinders, the reference position signal T unavoidably contains error components due to the transmission error mentioned above, resulting in that a phase deviation or shift takes place in the reference positions for the control, rendering it practically impossible or very difficult to realize the control with a high or satisfactory accuracy.

SUMMARY OF THE INVENTION

In the light of the state of the art described above, it is an object of the present invention to provide an internal combustion engine control apparatus in which the reference position signal can be generated with a high accuracy for the control of operation of a four-cycle engine having an odd number of cylinders, to thereby solve the problem which the conventional engine control apparatus suffers.

In view of the above and other objects which will become apparent as description proceeds, there is provided according to an aspect of the present invention an apparatus for controlling operation of a four-cycle internal combustion engine including an odd number of cylinders, which apparatus comprises a reference position signal generating means for generating a reference position signal in synchronism with rotation of a crank shaft of the internal combustion engine, wherein the reference position signal includes a number of constant-interval pulses generated periodically at a predetermined constant time interval during a single rotation of the crank shaft, the above-mentioned number of the constant-interval pulses being selected equal to a number of the cylinders multiplied by N, where N represents a natural number, a cylinder identification signal generating means for generating a cylinder identification signal in synchronism with rotation of a shaft interlocked to the crank shaft and having a rotational speed (i.e., the number of revolutions per minute) equal to a half of that of the crank shaft, the cylinder identification signal including a number of different-interval pulses generated at different time intervals, which number corresponds to that of the cylinders, and a control means for controlling the odd number of cylinders. The control means includes a synthesized reference position signal generating means for generating a synthesized reference position signal by dividing frequency of the reference position signal by $\frac{1}{2}N$ on the basis of level of the cylinder identification signal at edges of the constant-interval pulse, a cylinder discrimination means for generating a cylinder discrimination signal for identifying discriminatively each of the cylinders on the basis of the level of the cylinder identification signal at the edges of the constant-interval pulses, and a timing control means for controlling operation of the cylinders on the basis of the synthesized reference position signal and the cylinder discrimination signal.

With the arrangement of the engine control apparatus of the structure described above, a synthesized reference position signal containing no error is generated on the basis of the reference position signal containing the constant-interval pulses generated in synchronism with the rotation of the crank shaft and the cylinder identification signal containing the different-interval pulses generated in synchronism with a shaft interlocked to the cam shaft, wherein the cylinders are discriminatively identified on the basis of the reference position signal and the cylinder identification signal while the engine operation is controlled on the basis of the synthesized reference position signal and the cylinder discrimination signal. Accordingly, the reference position signal representing the reference position for the control can be generated in synchronism with the rotation of the crank shaft. In other words, the reference position signal can be made available with a very high accuracy according to the teachings of the present invention, whereby an improve reliability can be achieved for the control of the engine operation.

The above other object. s, features and attendant advantages of the present invention will more clearly be understood by reading the following description of the preferred embodiments thereof taken, only by way of example, by reference to the drawings.

DESCRIPTION OF THE PREFERRED EMBODIMENTS

Now, the present invention will be described in detail in conjunction with the preferred or exemplary embodiments thereof by reference to the drawings.

EMBODIMENT 1

Figure 1:
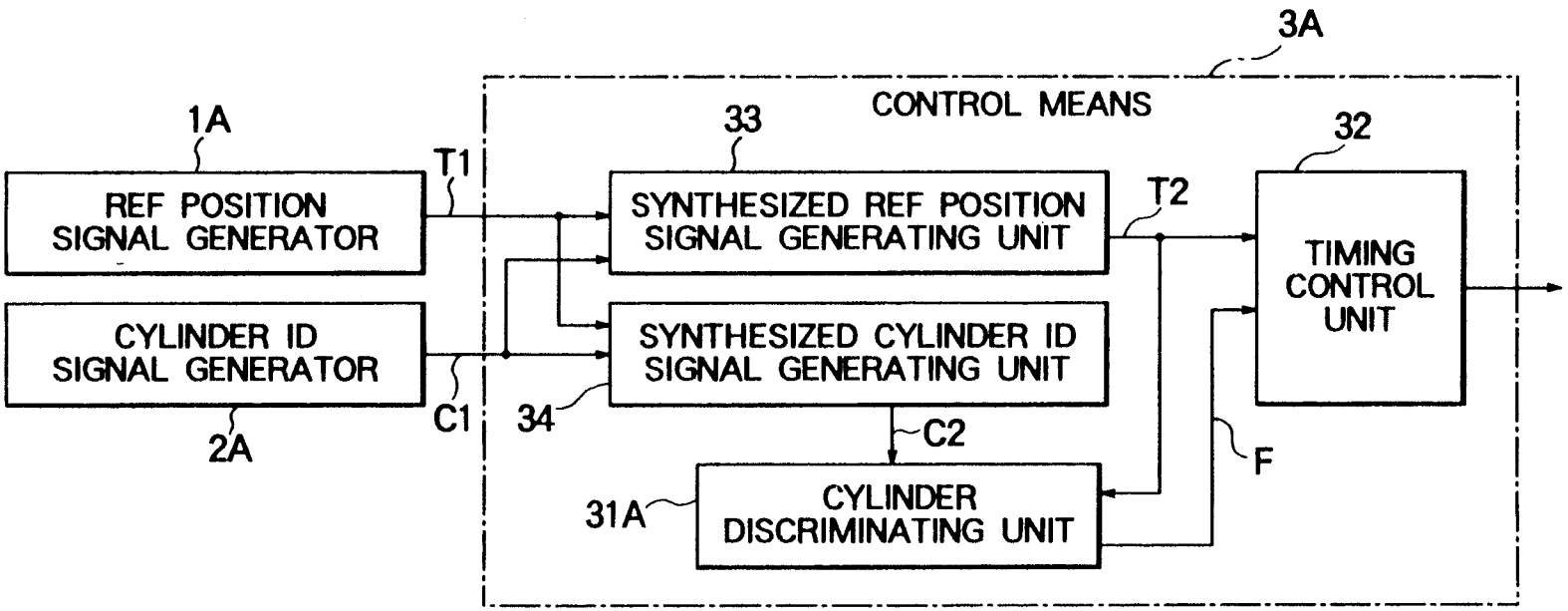
FIG. 1 is a block diagram showing a structure of an engine control apparatus according to an embodiment of the present invention.

FIG. 1 shows in a schematic block diagram a general arrangement of the engine control apparatus according to a first embodiment of the present invention. In this figure, reference symbols 1A, 2A, 3A and 31A denote components which correspond to the reference position signal generating means 1, the cylinder identification (ID) signal generating means 2, the control means and the cylinder discrimination means 31, respectively. Further, a reference numeral 32 denotes the same component described hereinbefore in conjunction with the related art.

The reference signal generating means 1A is designed to generate a reference position signal T1 which includes a number constant-interval pulse (described later on) generated in synchronism with the rotation of the crank shaft wherein the pulse repetition rate per rotation of the crank shaft corresponds to the number of the engine cylinders multiplied by N (representing a natural number). On the other hand, the cylinder identification (ID) signal generation means 2A is adapted to generate a cylinder identification signal C1 including a number of different-interval pulses (also described hereinafter) which correspond to the number of the cylinders in synchronism with rotation of a shaft (e.g. cam shaft) interlocked to the crank shaft and rotated at a frequency (rpm) equal to a half of that of the crank shaft.

The control means 3A is comprised of a synthesized reference position signal generating unit 33 for generating a synthesized reference (REF) position signal T2 (described later on) on the basis of the reference position signal T1 and the cylinder identification signal C1 and a synthesized cylinder identification (ID) signal generating unit 34 for generating a synthesized cylinder identification signal C2 (also described hereinafter) on the basis of the reference position signal T1 and the cylinder identification signal C1. More specifically, the synthesized reference position signal generating unit 33 generates the synthesized reference position signal T2 by dividing the pulse repetition frequency of the reference position signal T1 by $\frac{1}{2}N$ in dependence on the signal level of the cylinder identification signal C1 at every predetermined edge (e.g. leading or rise-up edge) of the constant-interval pulses contained in the reference position signal. On the other hand, the synthesized cylinder identification signal generating unit 34 generates the synthesized cylinder identification signal C2 for identifying discriminatively the engine cylinders in dependence on the level of the cylinder identification signal C1 at other edge (e.g. trailing or falling edge) of constant-interval pulse.

The synthesized cylinder identification signal C2 is then supplied to the cylinder discrimination unit 31A which identifies discriminatively the individual cylinders on the basis of the level of the synthesized cylinder identification signal C2 at the edges of the pulses contained in the synthesized reference position signal T2 to thereby generate a cylinder discrimination signal F. It should however be mentioned that cylinder discrimination unit 31A may alternatively generate -the cylinder discrimination signal F on the basis of the level of the cylinder identification signal C1 at the edges of the reference position signal T1.

The cylinder discrimination signal F is supplied together with the synthesized reference position signal T2 to a timing control unit 32 which controls the individual engine cylinders on the basis of the synthesized reference position signal T2 and the cylinder discrimination signal F.

Figure 2:
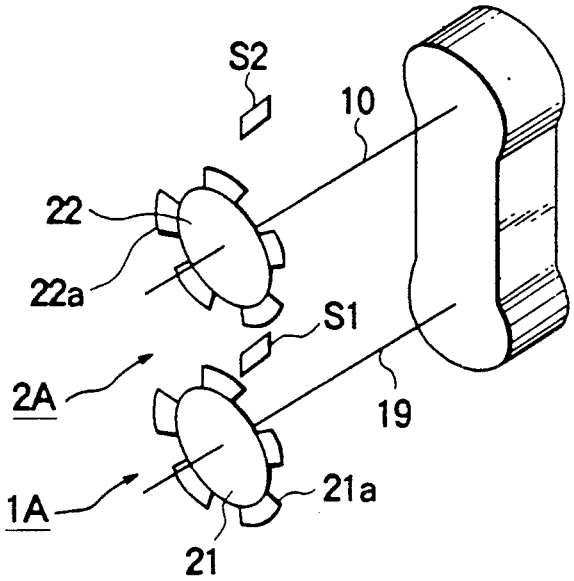
FIG. 2 is a schematic perspective view showing exemplary structures of a cylinder identification signal generating means and a reference position signal generation means shown in FIG. 1.

FIG. 2 is a perspective view showing schematically exemplary structures of the reference position signal generating means 1A and the cylinder identification signal generating means 2A. In this figure, a reference numeral 10 designates the cam shaft mentioned previously. The cam shaft 10 is operatively connected to a crank shaft 19 of the engine through the medium of a mechanical transmission means such as a combination of a chain and sprockets, a belt and pulleys, a gear train or the like so that the crank shaft 19 rotates twice during a signal rotation of the cam shaft 10.

Figure 6:
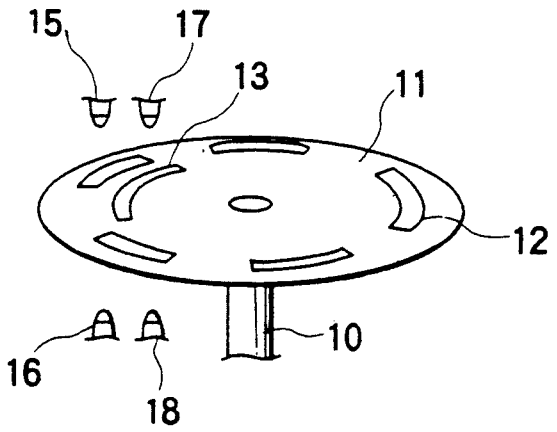
FIG. 6 is a schematic perspective view showing typical structures of a reference position signal generating means and a cylinder identification signal generating means incorporated in the conventional apparatus shown in FIG. 5.
Figure 7:
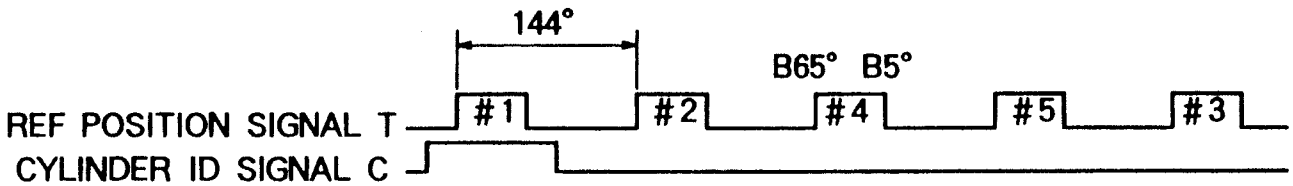
FIG. 7 is a timing chart for illustrating a reference position signal and a cylinder identification signal generated in the conventional engine control apparatus shown in FIG. 5.

A signal disk 21 adapted for generating the reference position signal T1 is mounted on the crank shaft 19 for rotation therewith. As can be seen in FIG. 2, the signal disk 21 has a number of teeth or projections 21*a* formed along the peripheral edge with equidistance therebetween for generating the constant-interval pulses which constitute the reference position signal T1, wherein the number of the teeth or projections corresponds to a number of the engine cylinder multiplied by a natural number N which is equal to "1" (one) in the case of the illustrated embodiment. Thus, the number of the projections 21*a* is five since it is assumed that the engine under consideration includes five cylinders. On the other hand, mounted on the cam shaft 10 for rotation therewith is a second signal disk for generating the cylinder identification signal C1, which disk 22 has a number of teeth or projections 22a which is equal to the number of engine cylinders. The angular distances between adjacent projections 22a differ from one to another so as to generate the different-interval pulses contained in the cylinder identification signal C1. A pair of sensors such as reflection type photosensors S1 and S2 are disposed in association with the signal disks 21 and 22 in opposition to the projections 21a and 22a, respectively. In this conjunction, it should however be mentioned that each of the reference position signal generating means 1A and the cylinder identification signal generating means 2A may alternatively be implemented in a slit/photodetector combination structure such as shown in FIG. 6, to the substantially same effect.

Figure 3:
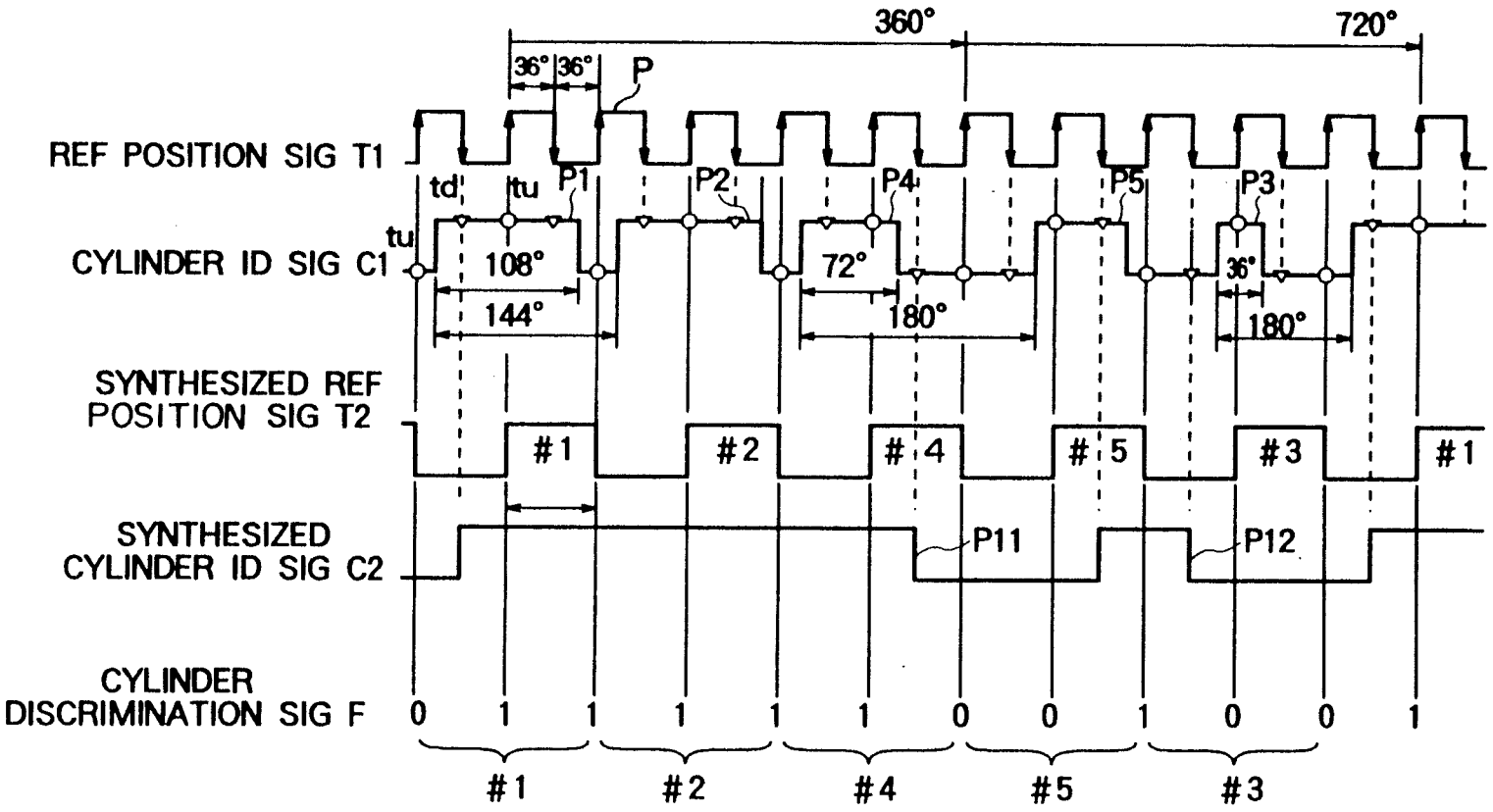
FIG. 3 is a timing chart for illustrating operation of the engine control apparatus according to the embodiment of the invention.

FIG. 3 is a timing chart for illustrating the cylinder discrimination signal F together with the waveforms of the reference (REF) position signal T1, the cylinder identification (ID) signal C1, the synthesized reference (REF) position signal T2 and the synthesized cylinder identification (ID) signal C2.

The constant-interval pulses P constituting the reference position signal T1 are generated a number of times which corresponds to the number of the cylinders (five in this case) multiplied by N (N=1) during a single rotation (360° in terms of the clank angle) of the clank shaft 19. Each of the constant-interval pulses P has a duty cycle of ½, a pulse period of 72° and a pulse width of 36° in terms of the crank angle, respectively.

The different-interval pulses P1 to P5 constituting the cylinder identification signal C1 are generated in a number corresponding to that of the engine cylinders (five in this case) during one rotation (720° in terms of the crank angle) of the interlocked shaft or cam shaft 10. In the case of the illustrated embodiment, each of the different-interval pulses P1 and P2 corresponding to the cylinders #1 and #2 has a pulse duration of 108°, each of the different-interval pulses P4 and P5 corresponding to the cylinders #4 and #5 has a pulse duration or width of 72°, while the different-interval pulse P3 corresponding to the cylinder #3 has a pulse width of 36° in terms of the clank angle, respectively. Further, the pulse period of the pulses P1 and P2 are set to be 144°, the period for the pulses P4 and P5 is 180° and the period for the pulse P3 is 108°, as can be seen in FIG. 3.

Each of the constant-interval pulses P of the reference position signal T1 has a leading edge rising up at a timing $t_d$ and a trailing edge falling at a timing $t_d$. P The synthesized reference position signal T2 is determined in dependence on the level of the cylinder identification signal C1 at the rise-up timing $t_d$ of the constant-interval pulses P and has a pulse repetition frequency corresponding to that of the reference position signal T1 divided by two. Thus, the synthesized reference position signal T2 rises up at B77° (indicating a crank angle of 77° before the top dead center) of the associated cylinder and falls at B5°.

On the other hand, the synthesized cylinder identification signal C2 is determined in dependence on the level of the cylinder identification signal C1 at the trailing edge timing $t_d$ of the constant-interval pulses P and thus contains pulses P11 and P12 of mutually different pulse widths P11 and P12 which are shifted in phase relative to the synthesized reference position signal T2.

The cylinder discrimination signal F contains successive bits whose values are determined in dependence on the levels of the synthesized cylinder identification signal C2 at the inversion timing of the synthesized reference position signal T2 and hence at the rise-up timing $t_u$ of the constant-interval pulses P, wherein the values of the three successive bits are utilized for identifying discriminatively or discriminating the reference positions of the cylinders #1 to #5. For example, when the three successive bits have values of "0" "1" and "1" the rise-up edge of the synthesized reference position signal T2 corresponding to the center bit indicates the reference position for the cylinder #1.

Next, operation of tile engine control apparatus shown in FIG. 1 will be described by reference to FIGS. 2 and 3.

In accompanying rotation of the engine, the crank shaft 19 and the cam shaft 10 are rotated, whereby the teeth or projections 21a and 22a of the signal disks 21 and 22 are successively scanned by the sensors S1 and S2, respectively. As a result, the reference position signal T1 and the cylinder identification signal Cl derived from the outputs of the sensors and S2 and having the waveforms illustrated in FIG. 3 are inputted to the control means 3A.

The synthesized reference position signal generating unit 33 incorporated in the control means 3A fetches the level of the cylinder identification signal C1 at the rise-up timing $t_u$ of the constant-interval pulses P to thereby generate the synthesized reference position signal T2 containing the pulses at the pulse repetition frequency corresponding to a half of that of the reference position signal T1. In this conjunction, it should be noted that since the reference position signal T1 is derived straightforwardly on the basis of the rotation of the crank shaft 19 of the engine, the reference positions indicated by the synthesized reference position signal T2 can not suffer from any error due to the error in the transmission elucidated hereinbefore in conjunction with the description of the related art.

On the other hand, the synthesized cylinder identification signal generating unit 34 fetches the level of the cylinder identification signal C1 at the trailing edge timing $t_d$ of the constant-interval pulses P to thereby generate the pulses P11 and P12 which are phase-shifted relative to the synthesized reference position signal T2 and have pulse widths differing each other. The discriminative identification or discrimination of the individual cylinder is ultimately carried out with the aid of these pulses P11 and P12. However, it should also be mentioned that such cylinder discrimination can equally be realized on the basis of the levels which the cylinder identification signal C1 assumes at the leading or trailing edges of the reference position signal T1.

The cylinder discrimination unit 31A stores in a memory incorporated therein trains of levels of the synthesized cylinder identification signal C2 at both edges of the synthesized reference position signal T2 and generates the cylinder discrimination signal F on the basis of the level trains each containing three bits.

In this case, the time taken for the cylinder discrimination processing to be completed lies within a range of 252° to 324° in terms of the crank angle, starting from the start of the engine rotation.

The timing control unit 32 recognizes or detects discriminatively the individual cylinders and the reference position for the cylinder which is currently controlled on the basis of the synthesized reference position signal T2, the synthesized cylinder identification signal C2 and the cylinder discrimination signal F, calculates the control timing such as the ignition timing in conformance with the engine operation state, as a result of which a corresponding control signal is outputted.

As will now be understood from the foregoing description, the reference position can be recognized or detected with a very high accuracy without suffering from any error due to the aforementioned transmission error on the basis of the constant-interval pulses P corresponding in the number to that of the odd number of the cylinders and generated in synchronism with the rotation of the crank shaft 19. This inturn means that the engine operation controls inclusive of the misfire control and others due to fluctuation in the rotation speed (rpm) can be performed with a significantly enhanced reliability.

EMBODIMENT 2

In the above description of the first embodiment, it has been assumed that the control is performed for the internal combustion engine which includes five cylinders. However, the teachings of the invention can equally be applied to the control of the engine having another number of cylinders.

Figure 4:
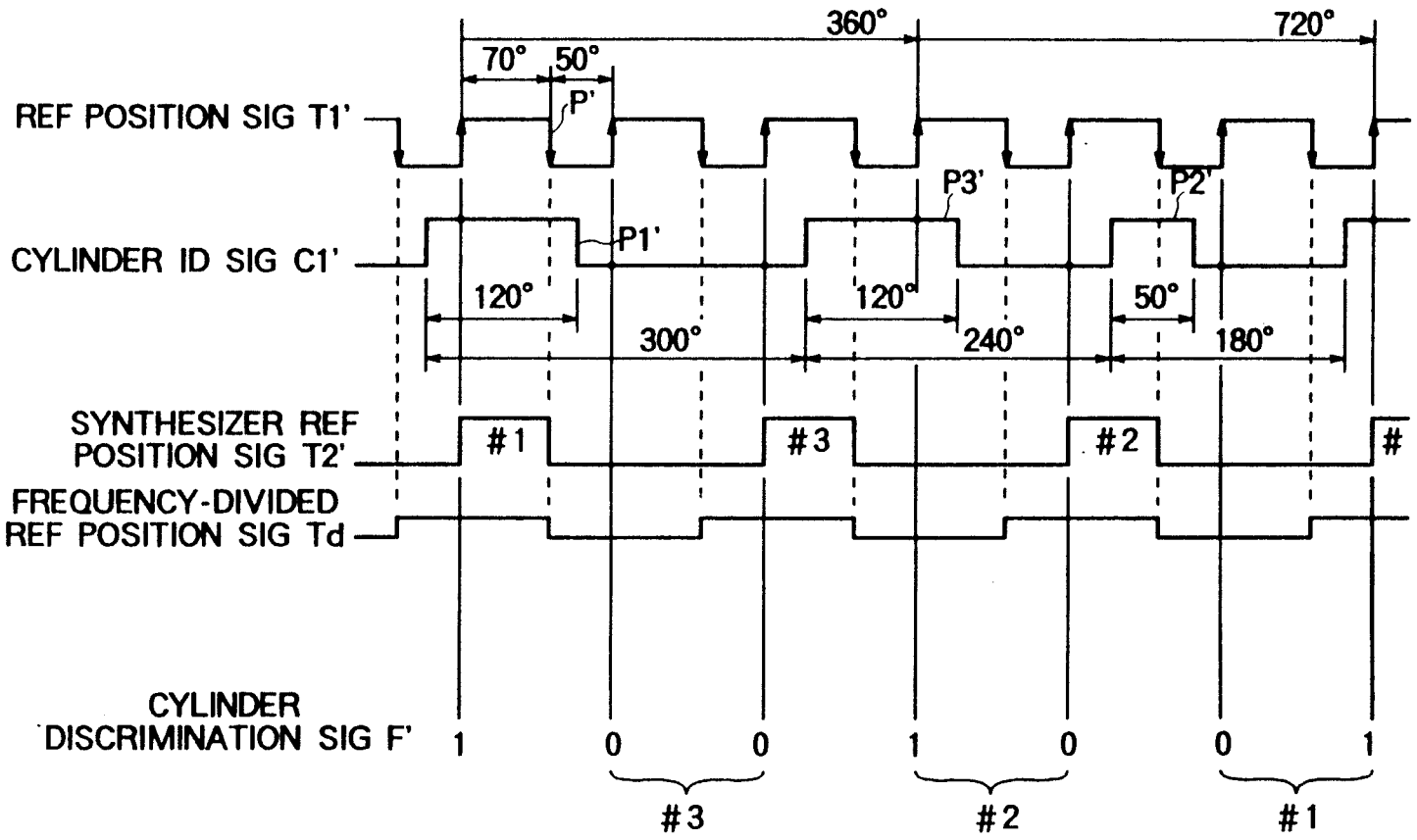
FIG. 4 is a timing chart for illustrating operation of the engine control apparatus according to another embodiment of the invention.
Figure 5:
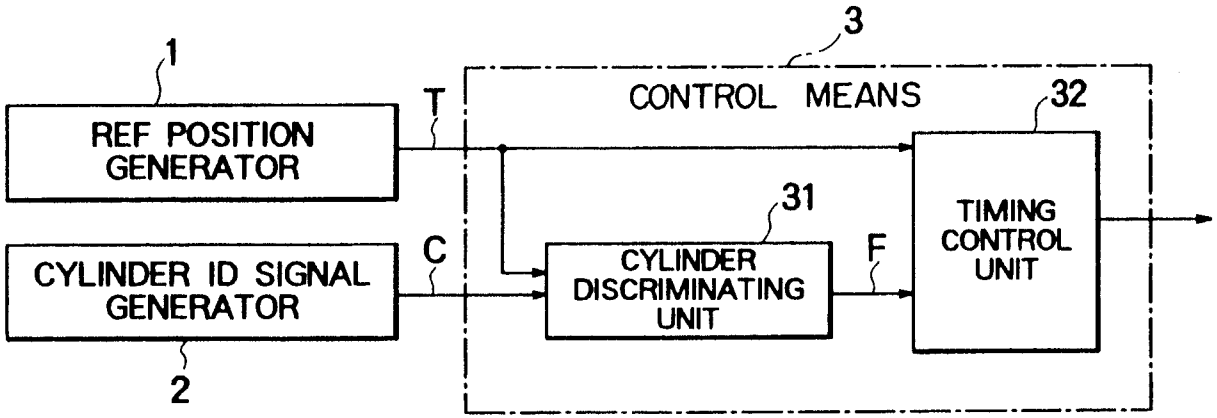
FIG. 5 is a block diagram showing schematically a structure of an engine control apparatus known heretofore.

FIG. 4 is a timing chart illustrating the reference position signal T1', the cylinder identification signal C1', the synthesized reference position signal T2' and the cylinder discrimination signal F' in the case where the engine of concern includes three cylinders. In this figure, a reference symbol $T_d$ denotes a frequency-divided reference signal used in generating the synthesized reference position signal T2' and containing the pulses resulting from the frequency division effected by using a flip-flop circuit at the trailing edge timing (falling timing) of the reference position signal T1'. In the case of the instant embodiment, the cylinders are discriminatively identified on the basis of the level of the cylinder identification signal C1' at the rise-up timing of the reference position signal T1'. Consequently, generation of the synthesized cylinder identification signal can be spared.

Each of the P' constituting the reference position signal T1' has a duty cycle or ratio of 7/12, a pulse width of 70'' and a pulse period of 120'' in terms of the crank angle, wherein the constant-interval pulses P' are generated in a number equal to that of the cylinders (three) multiplied by a natural number N (N=1 in this case) during every rotation (360°) of the crank shaft.

On the other hand, the different-interval pulses P1' to P2' constituting the cylinder identification signal C1' are generated in a number corresponding to that of the cylinders (three in the case under consideration) during a single rotation (720°) of the interlocked shaft or cam shaft 10. In this case, each of the different-interval pulses P1' and P3' corresponding to the cylinders #1 and #3, respectively, has a pulse width of 120° while the different-interval pulse P2 corresponding to the cylinder #2 has a pulse width of 50°. The periods at which the different-interval pulses P1' to P3' rise up are set to be 300°, 240° and 180°, respectively, in terms of the crank angle.

The synthesized reference position signal T2' is generated by logically ANDing the reference position signal T1' and the frequency-divided reference position signal Td derived by dividing the frequency of the synthesized reference position signal T2' by two and has rise-up or leading edge at B75° and a falling or trailing edge at B5°.

It should be mentioned that the synthesized reference position signal T2' can equally be generated by software processing instead of the hardware processing such as the logical ANDing operation. By way of example, the synthesized reference position signal T2' may be generated by validating interruption at the rise-up edge of the succeeding reference position signal T1' when the level of the cylinder identification signal C1' at the falling edge of the preceding reference position signal T1' is at low (L) level.

On the other hand, the cylinder discrimination unit (see FIG. 1) fetches and stores as data strings the levels of the cylinder identification signal C1' at the rise-up timing of the reference position signal T1'wherein the cylinders #1 to #3 are discriminatively identified on the basis of the values of two successive bits. By way of example, when the two successive bits has values of "0"and "0", the rise-up timing of the synthesized reference position signal T2' corresponding to the second bit is decided as the reference position of B75' for the cylinder #3 and supplied to the timing control unit 32 (refer to FIG. 1) as the cylinder discrimination signal F'.

Parenthetically, when only the discriminative identification for a particular cylinder (e g the cylinder #1) is required, this can be accomplished on the basis of the level of the cylinder identification signal C1' at the rise-up timing of the synthesized reference position signal T2'.

EMBODIMENT 3

In the case of the first and second embodiments described above, the number of the constant-interval pulses P or P' contained in the reference position signal T1 and T1' for a single rotation (360°) of the crank shaft 19 has been assumed to coincide with the number of the cylinders (five or three). However, this number of the pulses P and P' may be equal to a product resulting from multiplication of the cylinder numbers with a given natural number N. It will be appreciated that when N is greater than one, the accuracy of the control can correspondingly be enhanced. In this case, the synthesized reference position signal T2 or T2' can be derived by dividing the frequency of the reference position signal T1 or T2' by a factor of ½N.

Many features and advantages of the present invention are apparent form the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation illustrated and described. For example, although the present invention has been described in conjunction with the control of the internal combustion engine-including an odd number of cylinders, it goes without saying that the invention can in effect be applied to the control of operation of an engine having an even number of cylinders. Accordingly, all suitable modifications and equivalents may be resorted to, falling within the scope of the invention.

I claim:

1. An apparatus for controlling operation of a four-cycle internal combustion engine including an odd number of cylinders, comprising:

reference position signal generating means for generating a reference position signal in synchronism with rotation of a crank shaft of said internal combustion engine, said reference position signal including a number of constant interval pulses generated periodically at a predetermined constant time interval during a single rotation of said crank shaft, said number of the constant-interval pulses being selected equal to a number of said cylinders multiplied by N, where N represents a natural number;

cylinder identification signal generating means for generating a cylinder identification signal in synchronism with rotation of a shaft interlocked to said crank shaft and having a rotational speed equal to a half of that of said crank shaft, said cylinder identification signal including a number of different-interval pulses generated at different time intervals, said number corresponding to that of said cylinders; and control means for controlling said odd number of cylinders, including:

synthesized reference position signal generating means for generating a synthesized reference position signal by dividing frequency of said reference position signal by ½N and on the basis of a level of said cylinder identification signal at edges of said constant-interval pulses;

cylinder discrimination means for generating a cylinder discrimination signal for identifying discriminatively each of said cylinders on the basis of the level of said cylinder identification signal at the edges of said constant-interval pulses; and timing control means for controlling operation of each of said cylinders on the basis of said synthesized reference position signal and said cylinder discrimination signal.

2. An engine control apparatus according to claim 1, further comprising synthesized cylinder identification signal generating means for generating a synthesized cylinder identification signal on the basis of the level of said cylinder identification signal at the trailing edges of said constant-interval pulses;

wherein said cylinder discrimination means generates said cylinder discrimination signal on the basis of the level of said synthesized cylinder identification signal at leading edges of said constant-interval pulses of said reference position signal.

3. An engine control apparatus according to claim 2, wherein said cylinder discrimination signal identifies the cylinders with combinations of the levels of said synthesized cylinder identification signal at the leading edges of the constant-interval pulses of said reference position signal.

4. An engine control apparatus according to claim 1, further comprising:

frequency-divided reference position signal generating means for generating a frequency-divided reference position signal by dividing the frequency of said reference position signal, said frequency-divided reference position signal being utilized for generating said synthesized reference position signal.

5. An engine control apparatus according to claim 4, wherein said reference signal generating means includes a signal disk having a periphery formed with a number of projections with a constant distance therebetween, said number corresponding to that of the cylinders of said engine, said signal disk being mounted on said crank shaft for rotation therewith, and sensor means disposed in opposition to said projections.

6. An engine control apparatus according to claim 1, wherein said cylinder identification signal generating means includes a signal disk having a periphery formed with a number of projections with distances therebetween differing in correspondence to the intervals of said different-interval pulses, said number being corresponding to that of the cylinders of said engine, said signal disk being mounted on a cam shaft interlocked to said crank shaft through transmission means so that said cam shaft rotates once during a period in which said crank shaft rotates twice, and sensor means disposed in opposition to said projections.

* * * * *